United States Patent [19]

Vanderlaan

[11] Patent Number: 4,927,043

[45] Date of Patent: May 22, 1990

[54] NECKED-DOWN CAN HAVING A FALSE SEAM AND AN APPARATUS TO FORM SAME

[75] Inventor: Dirk Vanderlaan, Alameda, Calif.

[73] Assignee: Ihly Industries, Inc., Englewood, Colo.

[21] Appl. No.: 120,338

[22] Filed: Nov. 13, 1987

[51] Int. Cl.[5] ..... B65D 8/20

[52] U.S. Cl. ..... 220/67; 72/91; 220/83; 413/69

[58] Field of Search ..... 72/84, 93, 94, 91, 105, 72/110, 348, 349; 220/66, 70, 71, 72, 74, 83, DIG. 22; 413/8, 9, 69

[56] References Cited

U.S. PATENT DOCUMENTS

| | | | |
|---|---|---|---|
| 1,597,206 | 8/1926 | Mallory . | |
| 1,931,210 | 10/1933 | Steinacher | 220/DIG. 22 |
| 2,138,060 | 11/1938 | Conner | 220/72 |
| 2,156,237 | 4/1939 | Draper | 220/83 |
| 2,185,216 | 1/1940 | McManus et al. | 220/74 |
| 2,335,260 | 11/1943 | Chamberlain | 220/72 |
| 3,170,590 | 2/1965 | Ullman et al. | 220/72 |
| 3,268,109 | 8/1966 | Coppens | 220/72 |
| 3,315,839 | 4/1967 | Catalano et al. | 220/72 |
| 3,418,837 | 12/1968 | Vanderlaan et al. . | |
| 3,468,452 | 9/1969 | Khoury | 220/74 |
| 3,469,428 | 9/1969 | Aschberger . | |
| 3,472,418 | 10/1969 | Ullman | 220/72 |
| 3,531,967 | 10/1970 | Werge . | |
| 3,688,538 | 9/1972 | Hoyne . | |
| 3,754,424 | 8/1973 | Costanzo | 72/105 |
| 3,759,205 | 9/1973 | Dolveck | 72/348 |
| 3,998,174 | 12/1976 | Saunders | 113/120 |
| 4,058,998 | 11/1977 | Franek et al. | 72/84 |
| 4,070,888 | 1/1978 | Gombas . | |
| 4,246,770 | 1/1981 | Franek et al. . | |
| 4,331,014 | 5/1982 | Miller et al. | 72/93 |
| 4,341,103 | 7/1982 | Escallon et al. | 72/70 |
| 4,487,048 | 12/1984 | Frei . | |
| 4,512,172 | 4/1985 | Abbott et al. | 72/105 |
| 4,563,887 | 1/1986 | Bressan et al. . | |
| 4,578,007 | 3/1986 | Diekhoff | 72/105 |
| 4,732,027 | 3/1988 | Traczyk et al. | 413/69 |
| 4,781,047 | 11/1988 | Bressan et al. . | |

FOREIGN PATENT DOCUMENTS

| | | | |
|---|---|---|---|
| 0268299 | 1/1964 | Australia | 220/72 |
| 1324373 | 3/1963 | France | 220/72 |
| 0613588 | 12/1960 | Italy | 220/72 |
| 0602423 | 7/1978 | Switzerland | 220/74 |
| 0973373 | 10/1964 | United Kingdom | 220/72 |
| 1162958 | 9/1969 | United Kingdom | 220/72 |
| 1189566 | 4/1970 | United Kingdom | 220/72 |

OTHER PUBLICATIONS

Press release from Jan. 24–28, 1987 "International Exposition of Food Processors and Annual Convention of National Food Processors".

Tin International, p. 70, Mar. 1987.

Modern Metals, p. 68, Apr. 1987.

International Digest, Metal Box Engineering, Spring, 1988 VB 10 High Precision Vertical Beader, Frei Ag Maschinebau.

Description of the Krupp Vertical Beader (no date).

Descriptions of Carnation 12 Spindle Rotary Can Beaders, Models 201 and 202, Carnation Company, Can Division (no date).

*Primary Examiner*—Jimmy G. Foster

*Attorney, Agent, or Firm*—Sheridan, Ross & McIntosh

[57] ABSTRACT

The present disclosure is directed to a necked-down, three piece can having a false seam adjacent to the taper of the neck-down portion of the can to fascilitate even-rolling processing of the can after a food product is stored therein. The invention provides a novel apparatus to spin-flow form the neck-down, false seam configuration in the can body.

4 Claims, 3 Drawing Sheets

NECKED-DOWN CAN HAVING A FALSE SEAM AND AN APPARATUS TO FORM SAME

BACKGROUND AND SUMMARY OF THE INVENTION

The present invention is directed to an improved "necked-down" can configuration and to an apparatus for spin flow forming of the "necked-down" end of the can. More particularly, the invention provides an apparatus to simultaneously form both a conical end in the can to provide a "necked-down" can and a false seam to improve the handling of the "necked-down" can during subsequent processing operations.

A "necked-down" can is a container with a tapered end portion to reduce the diameter of the open end of the can. Necked-down cans are useful in the production of cans having easy-open ends which ordinarily use removable lids having diameters which are less than the outer diameters of the cylindrical bodies forming the cans. The reduction of the container diameter to permit the utilization of smaller diameter, easy-open lids has been done for many years in the two-piece container industry. Both the configuration of the two-piece container and the materials and processes typically used to manufacture the container are amenable to the material manipulating methods required to form the tapered or conical container end.

In the food industry, the majority of the containers used to package food are three-piece cans comprising a thin wall, hollow cylindrical body and separate top and bottom covers. The cylindrical body is rolled from sheet material and fastened along a longitudinal seam which is typically soldered, welded or cemented. Moreover, the cans are ordinarily made from a material such as double reduced steel which, together with the longitudinal seam, make the forming of a reduced diameter end difficult. In addition, the processing of the food after packaging in the can requires an even rolling of the can through equipment which generally engages the can at rolling support areas which are most advantageously located along the circumferential seams arranged at the top and bottom of the can to secure the top and bottom covers to the cylindrical body.

When the top portion of the cylindrical body is tapered to reduce the open end diameter of the can, the can can no longer be supported for rolling in the advantageous horizontal position, but will slant within the processing equipment. Thus, necked-down cans do not roll evenly and are prone to damage such as flange splitting during processing and agitated retort cooking. The above-described difficulties and disadvantages in the manufacture and handling of necked-down, three-piece cans has, as a practical matter, precluded the widespread use of necked-down cans in the food industry. Accordingly, the food industry has not been able to make full use of advantageous, smaller diameter, easy-open lids.

An apparatus which is operable to form a smooth conical neck in the cylindrical body of a three-piece can is disclosed in U.S. Pat. No. 4,563,887. Pursuant to the disclosure of the aforementioned U.S. Patent, an externally disposed free roll is moved inward and axially against the outside wall of the open end of a rotatably mounted cylindrical body. The free roll co-operates with a spring loaded interior support and an axially offset interior sleeve member to form a smooth conical end on the cylindrical body in a single spin flow forming operation. Thus, the apparatus described in U.S. Pat. No. 4,563,887 provides a straightforward means to form a necked-down configuration in the cylindrical body of a three-piece can. However, while the disclosure of U.S. Pat. No. 4,563,887 removes the heretofore encountered difficulties in the formation of a necked-down, three-piece can, the problem of uneven rolling during further processing still exists.

It is, therefore, a primary objective of the present invention to overcome the uneven rolling problem by providing a method and apparatus to simultaneously form both a smooth conical end and a false seam in the three-piece can. Generally, the invention comprises a necked-down cylindrical body including a false seam adjacent the conical, reduced diameter end of the cylindrical body. The diameter of the false seam is formed to be equal to the diameter of the seam at the unreduced bottom end of the cylindrical body. In this manner, the processing equipment can engage the bottom seam and the false seam to achieve an even rolling of the can, as in the case of a conventional three-piece can. Significantly, the reduced diameter of the can permits the use of a smaller diameter, easy-open lid.

Pursuant to the apparatus of the invention, an externally disposed free roll is formed to a predetermined surface profile and is controllably movable inwardly and axially to engage the exterior surface of a cylindrical body mounted upon a holder for rotation. The free roll co-operates with an offset, axially fixed, rotary sleeve member mounted within the interior of the cylindrical body. The rotary sleeve member is also formed to a predetermined surface profile and is positioned such that the axial, inward movement of the free roll against the cylindrical body wall and the interior rotary sleeve member deforms the cylindrical body wall between the predetermined surface profiles of the free roll and the offset, rotary sleeve. The co-operating surface profiles of the free roll and rotary sleeve deform the cylindrical body surface adjacent one end thereof, as it rotates, to an outwardly extending, circumferential bulge portion that then extends conically to the outer, now reduced end of the cylindrical body.

In accordance with the invention, the circumferential bulge is formed by the predetermined, co-operating surface profiles to a diameter which is equal to the diameter of the double seam at the unreduced bottom end of the cylindrical body. Thus, the circumferential bulge forms the false seam of the invention and the bulge and bottom seam of the cylindrical can provide equal diameter rolling support areas for even rolling processing. Likewise, the predetermined, co-operating surface profiles form the conical end to reduce the open top diameter of the cylindrical body to a diameter which is suitable for advantageous use in connection with any easy-open lid.

For a better understanding of the above and other features and advantages of the invention, reference should be made to the following detailed description and to the accompanying drawings.

DETAILED DESCRIPTION

Figure 1:
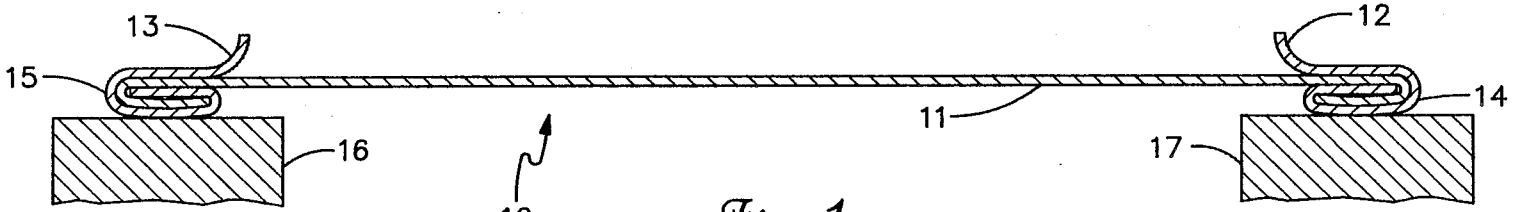
Fig. 1 (PRIOR ART)
FIG. 1 is a partial side view of a conventional three piece can mounted for even-rolling processing.
Figure 2:
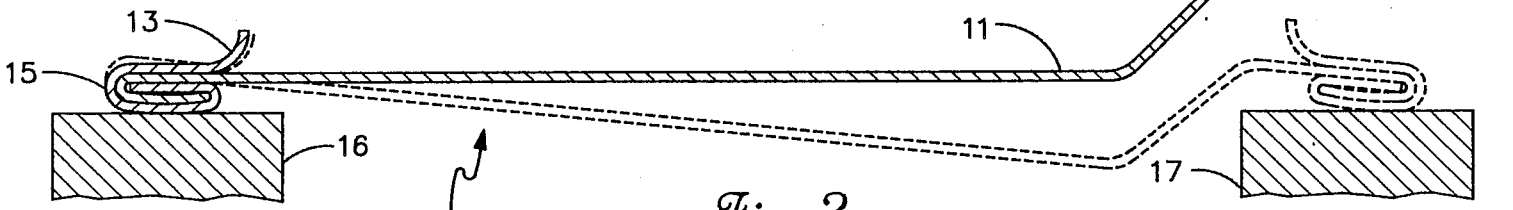
FIG. 2 in a partial, side view of a neck-down, three-piece can mounted for processing.

Referring now to the drawings, and initially to FIG. 1, there is illustrated a conventional three-piece can indicated by the reference numeral 10. The can 10 comprises a cylindrical body 11, a top member 12 and a bottom member 13. The top and bottom members 12, 13 are secured to the cylindrical body 10 by means of double rolled seams 14, 15, respectively, which seams 14, 15 form rolling support areas for engagement by processing equipment elements 16, 17, as is well known in the art, for even-rolling processing. As should be understood, if the diameter of the top end of the cylindrical body 11 is reduced to accommodate a smaller diameter, easy-open lid 12', the can 10 will not sit horizontally upon the elements 16, 17 and will, therefore not roll evenly through the processing equipment (See FIG. 2).

Figure 3:
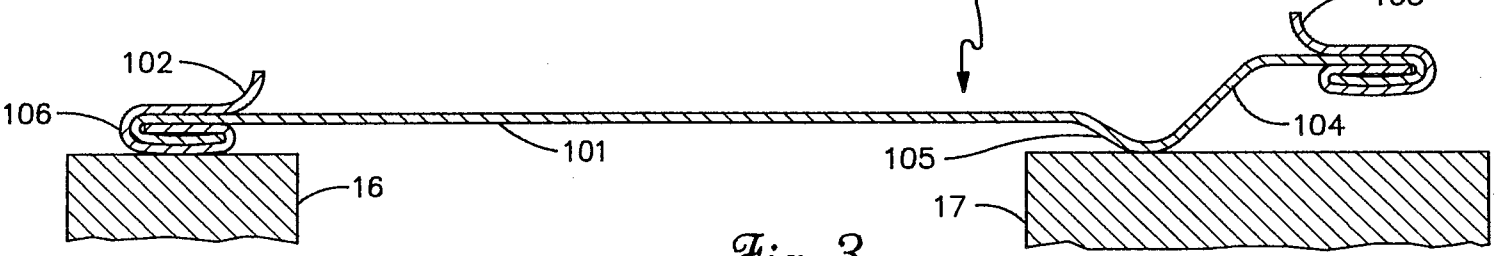
FIG. 3 is a partial, side view of a necked-down, three-piece can with a false seam mounted for even rolling processing in accordance with the invention.
Figure 7:
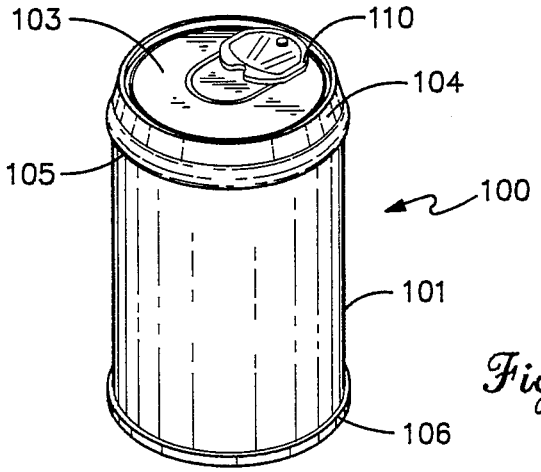
FIG. 7 is a perspective view of a necked-down, three-piece can including a false seam pursuant to the invention.

Accordingly, pursuant to the invention, a three-piece can 100 (FIGS. 3, 7) is provided including a cylindrical body 101, a bottom member 102, and a small-diameter, easy-open top cover 103 including an easy-open lid 110 of any suitable type, as is well known in the art. The bottom member 102 is secured to the cylindrical body 101 by a bottom seam 106. As clearly illustrated in FIGS. 3 and 7, the cylindrical body 101 is formed to include a generally conical top portion 104 tapered to the reduced diameter of the easy-open top cover 103 and a circumferential, outwardly extending bulge portion 105 to provide a false seam. The diameter of the bulge portion 105 is formed to be equal to the diameter of the bottom seam 106 such that the can 100 is supportable upon the processing equipment elements 16, 17 between the bottom seam 106 and the bulge portion 105 in an even, horizontal position for even-rolling processing, as clearly illustrated in FIG. 3. Moreover, the reduced diameter provided by the conical top portion 104 enables the use of the easy-open lid 103 with its attended advantages.

Figure 4:
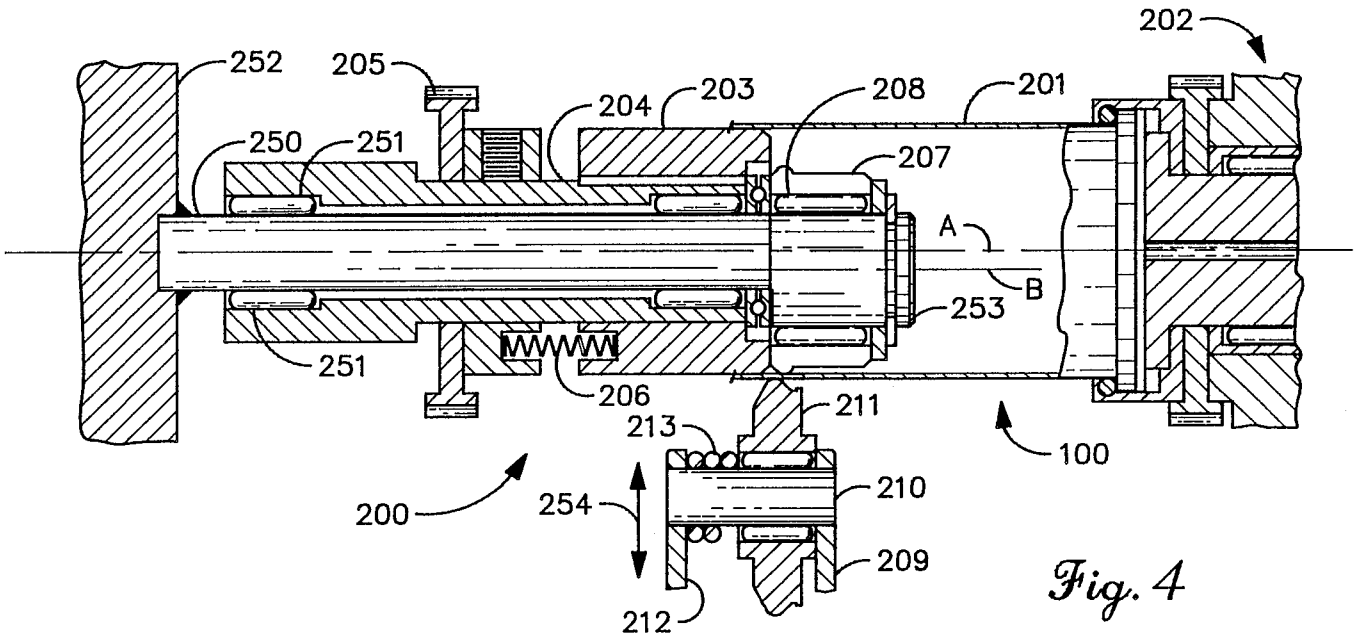
FIG. 4 is a side, cross-sectional view of the can-forming apparatus of the invention.

Pursuant to a further significant teaching of the invention, the necked-down, false seam can 100 is formed by a single, spin flow forming operation in an apparatus generally designated by the reference numeral 200 in FIG. 4. A straight-walled cylindrical body 201 is rotatably mounted at its ends within the apparatus 200 by a chuck assembly 202 and a longitudinally movable holder 203. The holder 203 is mounted upon a rotable shaft 204. The shaft 204 is controllably rotated by a gear drive element 205 to rotate the holder 203 and the cylindrical body 201 mounted thereon. The holder 202 is also longitudinally movable relative to the rotable shaft 204 and is biased toward the interior of the cylindrical body 201 by a coil spring 206. The shaft 204 is rotatably mounted upon a fixed shaft 250 by bearings 251. The fixed shaft 250 is secured to a wall structure 252 to support the entire rotary structure.

In accordance with the invention, a sleeve member 207 is mounted upon an end 253 of the fixed shaft 250 and freely rotatable by means of bearings 208 about an axis B which is parallel to but offset from the axis A of the rotatably mounted cylindrical body 201. The sleeve member 207 is mounted so as not to be movable in the longitudinal direction. A mandrel 209 is arranged exteriorly to the mounted cylindrical body 201 and is controllably, axially movable toward and away from the cylindrical body 201, as indicated by the arrow 254. The mandrel 209 includes a shaft member 210 to rotatably support a free roll 211 partially within an open slot 212 formed at the end of the mandrel 209. The free roll 211 is longitudinally movable relative to the shaft member 210 and is biased to the right, as illustrated, by a coil spring 213.

Figure 5:
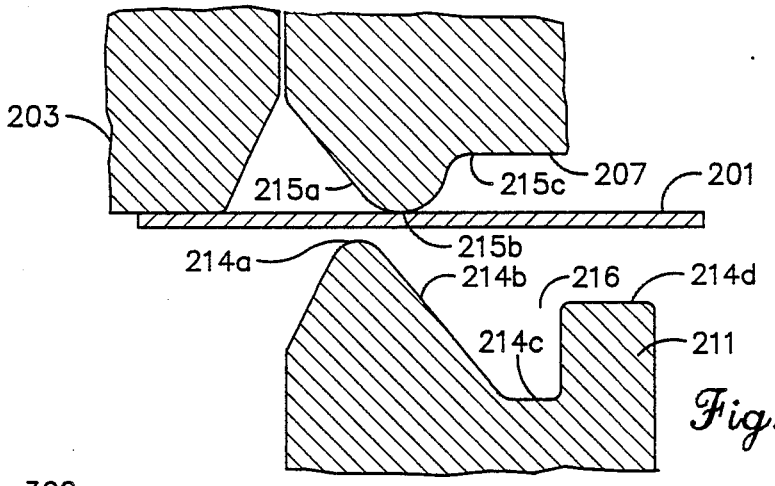
FIGS. 5 and 6 are exploded views of the rollers of the can-forming apparatus of FIG. 4 illustrating the operation of the apparatus.
Figure 6:
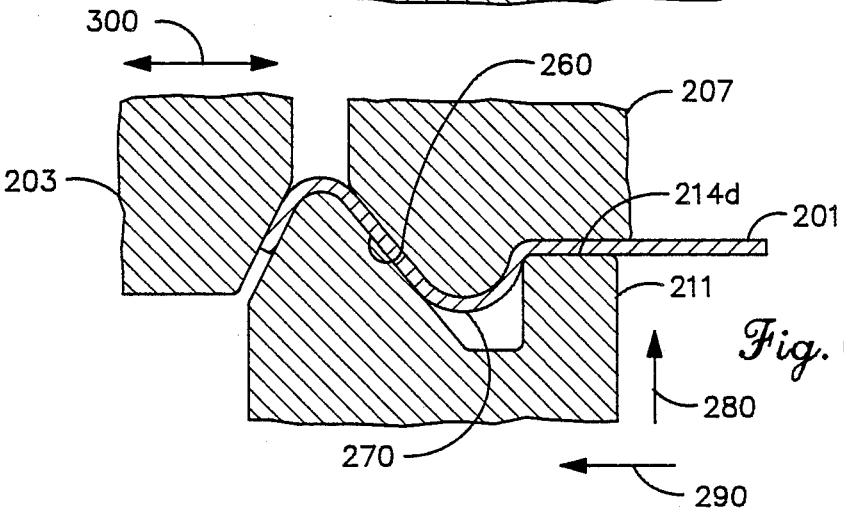

Refering now to FIGS. 5 and 6, each of the free roll 211 and sleeve member 207 is formed to outer contoured surfaces 214 a, b, c, d; 215 *a, b, c,* respectively. The surfaces 214, 215 have preselected profiles arranged to cooperate with one another to deform and shape the cylindrical body 201 into the desired conical end, false seam configuration, as will appear.

More specifically, the contoured surfaces 214 *a, b* of the free roll 211 are configured to a smoothly rounded top most portion 214*a* contiguous with a tapered trailing surface 214*b*. The trailing surface 214*b* extends to a cylindrical surface 214*c* which projects in a direction running parallel to the axes A, B. The cylindrical surface 214*c* terminates at an upwardly projecting step portion 214*d*. The tapered trailing surface 214*b*, cylindrical surface 214*c* and step portion 214*d* form a circumferentially extending groove designated by the reference numeral 216.

Pursuant to the invention, the taper of the trailing surface 214*b* is formed to an angle equal to the angle of a preselected tapered surface to be formed as the desired conical end of the cylindrical body 201. The mandrel 209 initially positions the free roll 211 relative to the cylindrical body 201 and sleeve member 207 such that the smoothly, rounded top most position 214*a* confronts a forward, tapered surface 215*a* of the internal sleeve member 207.

As clearly illustrated in FIGS. 5 and 6, a section of the outer wall of the rotatably mounted cylindrical body 201 extends between the confronting portions 214*a*, 215*a* of the externally mounted free roll 211 and internally mounted sleeve member 207. Moreover, the offset between the axes A, B is preselected to provide a contacting relation between the rotatably mounted cylindrical body 201 and a circumferential, bulge-forming rib portion 215*b* which forms a continuation of the forward, tapered surface 215*a* of the freely rotatable sleeve member 207. The remaining contour of the surface of the sleeve member 207 comprises a cylindrical surface 215*c* contiguous with and extending from the bulge-forming, rib portion 215*b* in a direction running parallel to the axes A, B.

In the operation of the apparatus 200, the cylindrical body 201 is rotated and the mandrel 209 is controllably moved inwardly toward the rotating cylindrical body 201. Eventually, the free roll 211 contacts the cylindrical body 201 and the continued inward movement of the mandrel 209 causes the tapered, trailing portion 214*b* of the free roll 211 to deform the cylindrical body 201 against the forward surface 215*a* of the internal sleeve member 207. As described above, the sleeve member 207 is not movable in the longitudinal direction, and accordingly, the inward movement of the free roll 211 against the cylindrical body 201 and forward surface 215*a* of the internal sleeve member 207 causes the longitudinally fixed sleeve member 207 to force the longitudinally movable free roll 211 against the biasing action of the coil spring 213. In this manner, the continued movement of the free roll 211 will be a combined inward and longitudinal movement, as indicated by the arrows 280, 290 which continues to deform the cylindrical body 201 between the tapered surfaces 214*b*, 215*a* until the step portion 214*d* contacts the cylindrical surface of the body 201 adjacent to the rib portion 215*b* (See FIG. 6). The combined movement of the free roll 211 also moves the holder 203 against the biasing action of the spring 206, as indicated by the arrow 300. Upon continued inward movement of the free roll 211, the step portion 214*d* applies pressure to the cylindrical body 201 proximate to the circumferential bulge-forming, rib portion 215*b* causing the cylindrical surface of the body 201 contacting the rib portion 215*b* to bulge outwardly away from the rib portion 215*b* and into the circumferentially extending groove 216.

At this position, the end of the cylindrical body 201 is contoured between the tapered surfaces 214*b*, 215*a* to a conical shape 260 to provide a necked-down cylindrical body 201 and between the bulge-forming, rib portion 215*b* and groove 216 to provide a circumferentially extending bulge portion 270 forming a false seam. The bulge-forming, rib portion 215*b* is formed to extend from the surface 215*c* by an amount sufficient to cause a false seam formation having an outer diameter which is equal to the external diameter of the circumferential seam that will be formed to secure a bottom cover to the unreduced end of the cylindrical body 201.

Thus, the present invention provides a highly advantageous necked-down can arrangement which is entirely suitable for use in connection with even rolling processing as is typically done in the food industry. The invention also provides a straightforward can forming apparatus and method to form the can configuration of the invention in a convenient single spin flow forming operation. The invention enables an economical manufacture of a necked-down can to permit the advantageous use of easy-open lid technology in the packaging of food products without any compromise in the effective handling of the food product after packaging.

What is claimed is:

1. A three-piece can which comprises:

(a) a thin wall, hollow cylindrical can body including open top and bottom ends, and;

(b) a pair of generally flat, circular cover elements;

(c) each of said cover elements being secured to one of the open ends of said cylindrical can body at a circumferential seam; each of said circumferential seams having an external diameter that is larger than the diameter of the cylindrical can body adjacent thereto;

(d) one of said cover elements having a diameter which is less than the diameter of said cylindrical can body;

(e) said cylindrical can body being formed to a tapered portion adjacent a reduced end portion upon which said one of said cover elements is secured;

(f) said cylindrical can body including a circumferential bulge portion immediately adjacent said tapered portion;

(g) said circumferential bulge portion having an external diameter which is equal to the external diameter of the circumferential seam securing the other of said cover elements to said cylindrical can body.

2. The three piece can according to claim 1, wherein said one of said cover elements includes an easy-open lid.

3. A three-piece can comprising first and second end pieces and a substantially cylindrical body therebetween, said first end piece being adjoined to a first end of said body to define a first adjoinment and said second end piece being adjoined to a second end of said body to define a second adjoinment, said body being integrally formed between said first adjoinment and said second adjoinment, said second adjoinment having a diameter less than said first adjoinment, said body having a circumferential bulge located near said second adjoinment, and said bulge having a diameter equal to the diameter of said first adjoinment and greater than the average diameter of the cylindrical body therebetween, wherein said can may roll substantially straight when horizontally oriented.

4. A three-piece can comprising first and second end pieces and a substantially cylindrical body therebetween, said first end piece being adjoined to a first end of said body to define a first adjoinment and said second end piece being adjoined to a second end of said body to define a second adjoinment, said body having a necked-in portion near said second adjoinment and having an outwardly tapered portion adjacent thereto, said second adjoinment having a diameter less than the diameter of said first adjoinment, said body having a circumferential bulge immediately adjacent to said tapered portion, said bulge having a diameter equal to the diameter of said first adjoinment and greater than the average diameter of the cylindrical body therebetween, wherein said can may roll substantially straight when horizontally oriented.

* * * * *